US005937807A

United States Patent [19]

Peters et al.

[11] Patent Number: 5,937,807

[45] Date of Patent: Aug. 17, 1999

[54] EARLY EXHAUST VALVE OPENING CONTROL SYSTEM AND METHOD

[75] Inventors: Lester L. Peters; David A. Vittorio; P. Douglas Free; Amarjit S. Ghuman; Harold G. Weber, all of Columbus; Canden R. Nelson, North Vernon, all of Ind.

[73] Assignee: Cummins Engine Company, Inc., Columbus, Ind.

[21] Appl. No.: 09/050,033

[22] Filed: Mar. 30, 1998

[51] Int. Cl.[6] ..... F01L 13/00

[52] U.S. Cl. ..... 123/90.15; 123/90.16; 123/559.1

[58] Field of Search ..... 123/90.15, 90.16, 123/90.39, 90.48, 559.1, 559.2; 60/605.1

[56] References Cited

U.S. PATENT DOCUMENTS

| | | | |
|---|---|---|---|
| 4,407,241 | 10/1983 | Butler et al. | 123/90.16 |
| 4,469,056 | 9/1984 | Tourtelot, Jr. et al. | 123/90.16 |
| 4,475,490 | 10/1984 | Oono et al. | 123/90.52 |
| 4,612,884 | 9/1986 | Ajiki et al. | 123/90.16 |
| 4,726,332 | 2/1988 | Nishimura et al. | 123/90.16 |
| 4,911,124 | 3/1990 | Bennett | 123/321 |
| 4,995,348 | 2/1991 | Melchoir | 123/90.15 |
| 5,002,022 | 3/1991 | Perr | 123/90.12 |
| 5,233,948 | 8/1993 | Boggs et al. | 123/64 |
| 5,253,621 | 10/1993 | Dopson et al. | 123/90.16 |
| 5,287,830 | 2/1994 | Dopson et al. | 123/90.16 |
| 5,415,137 | 5/1995 | Paul | 123/90.16 |
| 5,421,308 | 6/1995 | Hitomi et al. | 123/90.15 |
| 5,427,078 | 6/1995 | Hitomi et al. | 123/90.15 |
| 5,503,120 | 4/1996 | Shirey et al. | 123/90.16 |
| 5,503,121 | 4/1996 | Speil et al. | 123/90.22 |
| 5,531,192 | 7/1996 | Feucht et al. | 123/90.12 |
| 5,609,133 | 3/1997 | Hakansson | 123/90.16 |
| 5,611,204 | 3/1997 | Radovanovic et al. | 123/574 |
| 5,617,726 | 4/1997 | Sheridan et al. | 60/605.2 |
| 5,626,116 | 5/1997 | Reedy et al. | 123/321 |
| 5,829,397 | 11/1998 | Vorih et al. | 123/90.16 |

*Primary Examiner*—Weilun Lo

*Attorney, Agent, or Firm*—Sixbey, Friedman, Leedom & Ferguson, PC

[57] ABSTRACT

An exhaust valve system for an internal combustion engine including a turbocharger is provided for effectively increasing the turbocharged boost pressure at low load engine conditions thereby effectively improving engine transient response. The exhaust valve system includes an exhaust valve control device operable in a normal timing mode for permitting normal opening of one or more exhaust valves at a normal opening crank angle, and in an advanced timing mode for advancing the timing of the opening of the exhaust valve to an advanced opening crank angle prior to the normal opening crank angle while maintaining the timing of normal closing of the exhaust valves at a normal closing crank angle. In one embodiment, the exhaust valve control device includes a tappet and an actuating fluid supply which operate to move the tappet between expanded and collapsed states to advance the opening of the exhaust valve while permitting normal exhaust valve lift to be introduced prior to peak exhaust valve lift thereby maintaining the normal peak lift and the normal timing of exhaust valve closure. In a second embodiment, the exhaust valve control device includes a dedicated advanced timing mode rocker lever capable of selectively actuating one of a pair of exhaust valves to create an early opening exhaust event prior to a normal exhaust event.

27 Claims, 5 Drawing Sheets

EARLY EXHAUST VALVE OPENING CONTROL SYSTEM AND METHOD

TECHNICAL FIELD

The present invention relates to valve control systems for selectively controlling the opening of an exhaust valve in an internal combustion engine. More specifically, this invention relates to a system and method of controlling the opening of engine exhaust valves to enhance engine operation throughout a range of operating conditions.

BACKGROUND OF THE INVENTION

Diesel engines have long been used to provide power generation in variety of applications, including industrial and vehicular, while achieving higher thermal efficiency than the popular spark-ignited engine. The higher efficiency of diesel engines results from the ability to create higher compression ratios while controlling the diesel engine's power output without a throttle. This eliminates the throttling losses of spark-ignited engines and results in significantly higher efficiency at part load for diesel engines.

Many diesel engines include a turbocharger for increasing the power output of the engine by increasing the mass flow rate of air to each cylinder thereby allowing a corresponding increase in the fuel flow rate. However, engine transient response of turbocharged diesel engines is limited by the turbocharger's inability to go from turbine wheel idle or low load operating speeds to full load operating speeds in an expedient manner. In fact, the fuel flow must be gradually increased to fall load conditions to match the response of the turbocharger so as to not create smoke due to a low air fuel ratio. One way to improve transient response is to utilize smaller turbochargers with lower inertias. However, smaller turbochargers undesirably limit peak engine performance. Also, regardless of the size of the turbocharger, diesel engines may produce an undesirably high level of unburned hydrocarbons (UHC) at reduced idle. Moreover, turbocharged diesel engines are sometimes unable to provide sufficient torque at low engine speeds as required in certain applications.

U.S. Pat. No. 5,233,948 to Boggs et al. discloses a variable cycle engine which varies the timing of an exhaust valve event at low load engine conditions to achieve high engine efficiency. During idle conditions, exhaust valve opening is maintained at less than 90 degrees before bottom dead center (BDC). As the load increases to a light load condition, the system retards exhaust valve opening by 35 degrees. As a result, the exhaust valves are not advanced from the conventional timing. Moreover, this reference no where suggest using the valve timing system with a turbocharged diesel engine. In addition, the system necessarily changes the timing of both exhaust valve opening and closing.

U.S. Pat. No. 4,469,056 to Tourtelot, Jr. discloses a variable valve timing system including a valve operating device including a rocker lever activated by a cam having a profile which opens an exhaust valve earlier in the expansion stroke of an engine piston to optimize engine efficiency at predetermined operating conditions. However, the exhaust valve opening is advanced an insufficient number of degrees before BDC. Also, the system disadvantageously retards exhaust valve closing when causing an advance in exhaust valve opening.

Consequently, there is a need for an improved variable valve timing control system for selectively causing an early opening of an exhaust valve so as to improve turbocharged diesel engine performance.

SUMMARY OF THE INVENTION

It is an object of the present invention, therefore, to overcome the disadvantages of the prior art and to provide an exhaust valve system for controlling the opening of an engine exhaust valve so as to produce higher low speed engine torque and faster engine response during transients.

It is another object of the present invention to provide an exhaust valve system including an exhaust valve opening control device capable of selectively opening an exhaust valve early in the expansion stroke of an engine piston to provide extra exhaust energy for operating a turbocharger.

It is a further object of the present invention to provide an exhaust valve system including an exhaust valve opening control device capable of selectively providing an early opening of the exhaust valve while maintaining the normal timing of exhaust valve closing.

It is still another object of the present invention to provide an exhaust valve system capable of providing an early exhaust valve opening under light load and idle engine conditions for increasing turbocharger speed and thus increasing boost.

A still further object of the present invention is to provide an exhaust valve system for a turbocharged diesel engine capable of being selectively switched between a normal timing mode during loaded engine conditions and an advanced timing mode during idle or low load engine conditions.

A still further object of the present invention is to provide an exhaust valve system capable of selectively controlling the timing of exhaust valve opening without effecting exhaust valve peak lift and the timing of exhaust valve closing.

It is a still further object of the present invention to provide an exhaust valve system capable of providing early exhaust valve opening while reducing unburned hydrocarbons and acceleration smoke.

Yet another object of the present invention is to provide an exhaust valve system capable of increasing exhaust valve temperatures at selected engine operating conditions for proper operation of an exhaust catalyst.

Still another object of the present invention is to provide an exhaust valve system which provides more exhaust energy during low engine speeds and low loads to create a higher turbocharger speed at idle or low load operating speeds thereby decreasing the engine transient response time from idle or low load conditions to high load or high speed engine conditions.

These and other objects of the present invention are achieved by providing an exhaust valve system for an internal combustion engine having a crankshaft mounted for rotation, at least one engine piston operatively connected to the crankshaft for reciprocal movement within a cylinder through cyclical successive compression and expansion strokes, an exhaust system and a turbocharger positioned in the exhaust system, comprising at least one exhaust valve reciprocally mounted in the engine for movement between open and closed positions; and an exhaust valve actuating system for moving the exhaust valve between the open position and the closed position wherein the exhaust valve actuating device includes an exhaust valve opening control device for varying the timing of the opening of the exhaust valve during engine operation. The exhaust valve opening control device is operable in a normal timing mode for permitting normal opening of the exhaust valve at a normal opening crank angle prior to an end of the expansion stroke and subsequently permitting normal closing of the exhaust valve at a normal closing crank angle. The exhaust valve opening control device is also operable in an advanced timing mode during at least one of idle engine conditions and low load engine conditions for advancing the timing of the opening of the exhaust valve to an advanced opening crank angle substantially prior to the normal opening crank angle while maintaining the timing of normal closing of the exhaust valve at the normal closing crank angle so as to increase to the speed of the turbocharger compressor during operation in the advanced timing mode.

In one embodiment, the exhaust valve opening control device operates in the advanced timing mode to close the exhaust valve subsequent to the advanced opening of the exhaust valve to permit subsequent reopening of the exhaust valve prior to the normal closing of the valve. The exhaust valve actuating system may include a normal mode rocker lever pivotally mounted adjacent the exhaust valve for opening the valve when the exhaust valve opening control device is operating in the normal timing mode. The exhaust valve actuating system may also include a first cam for pivoting the normal mode rocker lever. The exhaust valve opening control device may also include an advanced timing mode rocker lever pivotally mounted adjacent the exhaust valve for opening the exhaust valve when the exhaust valve opening control device is operating in the advanced timing mode and a second cam for pivoting the advanced timing mode rocker lever. The exhaust valve opening control device further includes a control fluid circuit formed in the advanced timing mode rocker lever and a control fluid valve for controlling the flow of control fluid through the control fluid circuit. The control fluid circuit includes a low pressure circuit for delivering low pressure fluid to the control fluid valve and a high pressure circuit for receiving low pressure fluid from the low pressure circuit. The control fluid valve is operable to control the flow of control fluid between the low pressure circuit and the high pressure circuit. Preferably, the control fluid valve is mounted on the advanced timing mode rocker lever. The second cam pivots the advanced timing mode rocker lever by applying an advanced timing mode actuating force to a first end of the advanced timing mode rocker lever positioned adjacent the second cam. An actuator piston bore is formed in a second end of the advanced timing mode rocker lever and an actuator piston is slidably mounted in the actuator piston bore. A first biasing device for biasing the actuator piston into the actuator piston bore is used to create a spaced distance between the actuator piston and the exhaust valve during operation in the normal timing mode. The at least one exhaust valve may include a first exhaust valve for opening solely by the normal mode rocker lever during the normal timing mode and a second exhaust valve for opening by both the normal mode rocker lever and the advanced mode rocker lever during the advanced timing mode.

In another embodiment, the exhaust valve opening control device includes a tappet operable in an expanded state to cause the advanced timing mode and a collapsed state for permitting operation in the normal timing mode. The tappet may be movable through an exhaust valve actuation stroke including an opening stroke portion moving the exhaust valve from the closed to the open position and a closing stroke portion moving the exhaust valve from the open to the closed position. The tappet transitions from an expanded state to the collapsed state during the opening stroke portion. Preferably, the tappet is positioned along a pushrod assembly which acts on a rocker arm. The exhaust valve opening control device may include an actuating fluid supply for selectively supplying pressurized actuating fluid to initiate the advanced timing mode. The tappet may also include an actuating fluid circuit for receiving the pressurized actuating fluid. A drain circuit is provided for draining fluid from the actuating fluid circuit. Also, the tappet may include a tappet housing in a tappet body mounted for reciprocal movement in the tappet body. The drain circuit includes at least one drain port formed in the tappet housing while the tappet body is movable through an exhaust valve actuation stroke during the advanced timing mode to sequentially connect the actuating fluid circuit to the actuating fluid supply to place the tappet in the expanded state. Subsequently, the actuating fluid circuit is fluidically connected to the drain port for placing the tappet in the collapsed state during movement through the actuation stroke. Preferably, the exhaust valve opening control device operates in the advanced timing mode for advancing the timing of the opening of the exhaust valve to an advanced opening crank angle at least 90 crank angle degrees prior to an end of the expansion stroke.

The present invention is also directed to a method for controlling the timing of opening of an exhaust valve in an internal combustion engine having a crankshaft mounted for rotation, at least one engine piston operatively connected to the crankshaft for reciprocal movement within a cylinder through cyclical successive compression and expansion strokes, an exhaust system and a turbocharger compressor positioned in the exhaust system. The method comprises the steps of providing at least one exhaust valve mounted in the engine for movement between open and closed positions, operating the engine in a normal timing mode causing normal opening of the exhaust valve at a normal opening crank angle prior to an end of the expansion stroke and subsequently permitting normal closing of the exhaust valve at a normal closing crank angle, and changing the operation of the engine from the normal timing mode to an advanced timing mode during at least one of idle engine conditions and low load engine conditions for advancing the timing of the opening of the exhaust valve to an advanced opening crank angle earlier than the normal opening crank angle while maintaining the timing of normal closing of the exhaust valve at the normal closing crank angle so as to increase the speed of the turbocharger compressor during operation in the advanced timing mode.

DETAILED DESCRIPTION OF THE PREFERRED EMBODIMENTS

Figure 1:
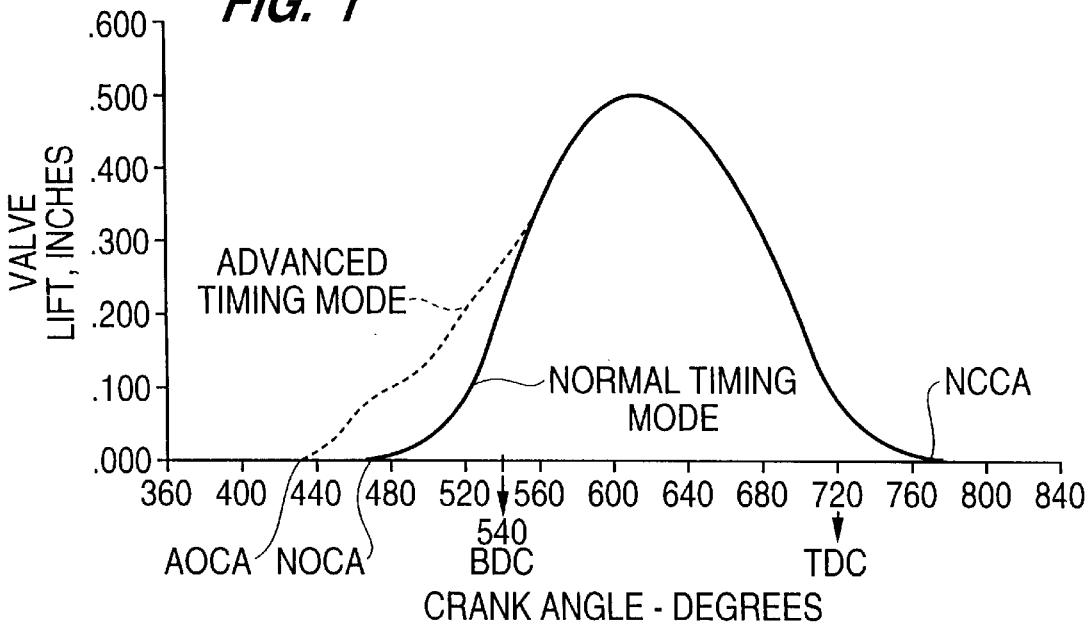
FIG. 1 is a graphical illustration representing the degree of exhaust valve opening versus time measured by degrees of the engine crankshaft with the exhaust valve system of the present invention in a normal timing mode and an advanced timing mode.
Figure 2:
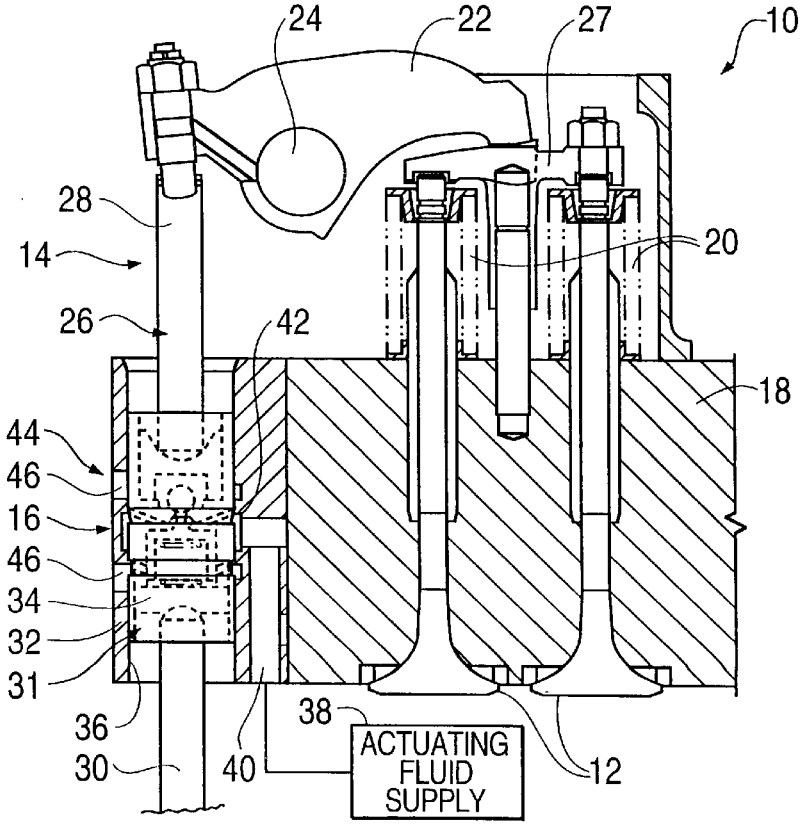
FIG. 2 is a cross sectional view of an engine cylinder head incorporating the exhaust valve system of a first embodiment of the present invention.

Referring now to FIGS. 1 and 2, a first embodiment of the exhaust valve system of the present invention, indicated generally at 10 in FIG. 2, is shown. Exhaust valve system 10 is specifically designed for a diesel engine including a turbocharger utilizing the energy in the exhaust gas flow to generate an intake boost pressure thereby increasing the power output of the engine, such as disclosed in U.S. Pat. Nos. 5,611,204 and 5,617,726, the entire contents of which are hereby incorporated by reference. Exhaust valve system 10 may be used in any conventional turbocharged diesel engine which includes a crankshaft rotated by one or more pistons mounted in respective cylinders for reciprocal movement through cyclical successive compression, expansion, exhaust and intake strokes. An exhaust manifold or passage extending from each cylinder delivers the exhaust gas to a turbine portion of a turbocharger positioned in the exhaust passage. Exhaust valve system 10 of the present invention includes one or more exhaust valves 12 for controlling the exhaust gas flow from each engine cylinder, an exhaust valve actuating system 14 for moving exhaust valves 12 between an open position permitting exhaust flow into the exhaust passage and a closed position blocking exhaust flow from the respective cylinder, and an exhaust valve control device 16 for creating an early exhaust valve opening (EEVO) by varying the timing of the opening of the exhaust valves during engine operation. As discussed more fully hereinbelow, the early exhaust valve opening results in increased exhaust energy to the turbocharger turbine thereby increasing turbocharger speed and the transient response of the engine.

One or more exhaust valves 12 are mounted in a cylinder head 18 positioned on an engine block (not shown) so as to close off each engine cylinder in a conventional manner. Exhaust valves 12 are biased into the closed position as shown in FIG. 2 by respective bias springs 20. A rocker arm 22 pivotally mounted on a rocker shaft 24, abuts, at one end, a valve bridge 27 connected to each exhaust valve 12. An opposite end of rocker arm 22 operatively engages a pushrod assembly 26. Exhaust valve control device 16 is mounted in cylinder head 18 and positioned along pushrod assembly 26. Pushrod assembly 26 includes a first pushrod portion 28 extending between exhaust valve control device 16 and rocker arm 22 and a second pushrod 30 extending from the opposite side of exhaust valve control device 16 for operation by a cam lobe (not shown).

Figure 3:
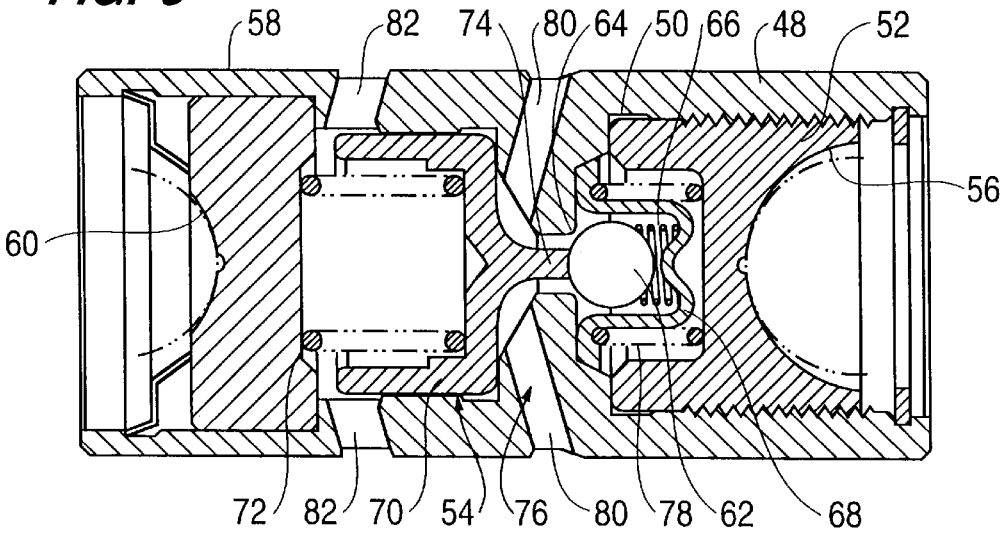
FIG. 3 is an exploded cross sectional view of the tappet device of FIG. 2.

Referring to FIGS. 2 and 3, exhaust valve control device 16 includes a tappet device 31 including a tappet housing 32 mounted in cylinder head 18 and a tappet body 34 mounted for reciprocation in a tappet bore 36 formed in tappet housing 32. Exhaust valve control device 16 also includes an actuating fluid supply 38 for delivering actuating fluid to a supply circuit 40 formed in tappet housing 32. Supply circuit 40 includes a supply port 42 opening into tappet bore 36. A drain circuit 44, including a pair of drain ports 46 positioned axially on both sides of supply port 42, is provided to relieve or drain high pressure actuating fluid from tappet body 34 as described more fully hereinbelow.

Referring to FIG. 3, tappet body 34 includes an outer body shell 48 forming an inner cavity 50 for receiving a tappet piston 52 and a tappet valve assembly 54. Tappet piston 52 is mounted for reciprocal movement in one end of inner cavity 50 and includes a spherical surface 56 for engaging a complementary shaped spherical surface formed on first pushrod 28 (FIG. 2). A stationary load support 58 is positioned at the other end of inner cavity 50 and includes a spherical mating surface 60 for engaging a complementary shaped spherical surface formed on second pushrod 30. Tappet valve assembly 54 includes a check ball 62 biased toward a valve seat 64 by a bias spring 66 positioned in a valve cage 68 surrounding check ball 62. Tappet valve assembly 54 also includes a trigger plunger 70 mounted for reciprocal movement in inner cavity 50 on an opposite side of valve seat 64 from check ball 62. Trigger plunger 70 is biased by a spring 72 toward check ball 62 and includes a trigger extension 74 extending to contact check ball 62 when tappet device 31 is in a collapsed state, as shown in FIG. 3, with trigger plunger 70 in an extended position toward check ball 62. The tappet device 31 further includes an actuating fluid circuit 76 which includes a high pressure chamber 78 positioned between valve seat 64 and tappet piston 52. Actuating fluid circuit 76 also includes a first set of transfer passages 80 for intermittently fluidically connecting inner cavity 50, adjacent the check ball side of trigger plunger 70, to drain circuit 44 and supply circuit 40. Actuating fluid circuit 76 also includes a second set of transfer passages 82 extending through body shell 48 to fluidically connect inner cavity 50 on the opposite side of trigger plunger 70 from check ball 62, alternately to drain circuit 44 and supply circuit 40.

During operation, exhaust valve actuating system 14 functions to move exhaust valves 12 from the closed position into an open position and subsequently return the exhaust valves to the closed position as shown graphically in FIG. 1. During a normal timing mode, indicated by a solid line in FIG. 1, the exhaust valve opens during the latter portion of the expansion stroke of the engine piston to allow exhaust gas to flow out of the engine cylinder into the exhaust system and to the turbocharger turbine. Exhaust valve control device 16, and specifically tappet device 31, of the present invention functions to advance the opening of the exhaust valves 12 by actuating the tappet device into an expanded state prior to the beginning of the exhaust actuation stroke while maintaining the normal timing of exhaust valve closing by collapsing the tappet device during the opening stroke portion of the actuation stroke, as indicated in FIG. 1 by the merging of the advanced timing mode line into the normal timing mode line prior to peak valve lift.

Figure 4A:
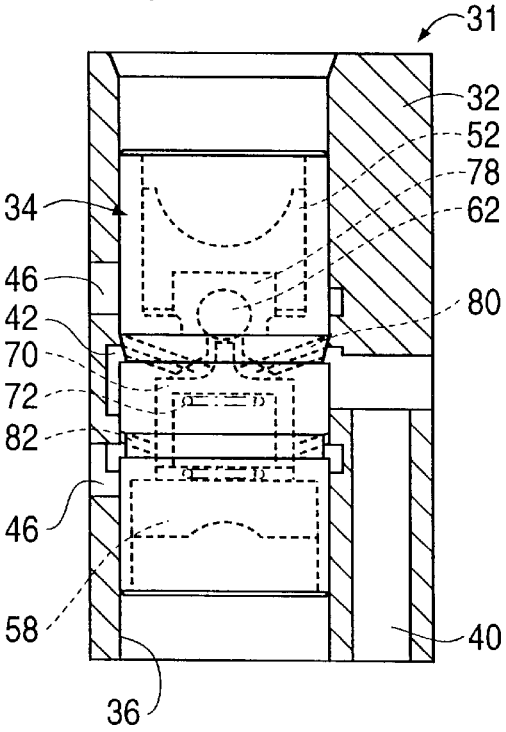
FIG. 4*a* is a partial cross sectional view of the tappet device of FIG. 3 showing the tappet device in the expanded state.
Figure 4B:
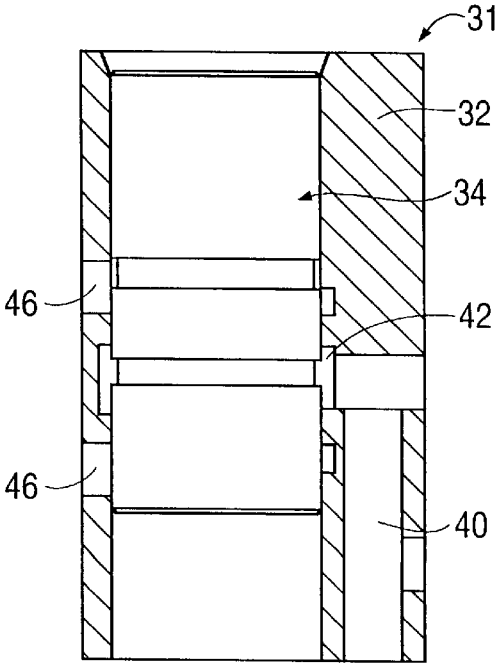
FIG. 4*b* is a partial cross sectional view of the tappet device of FIG. 3 showing the tappet body in the latter part of the exhaust valve opening portion of the actuation stroke.

Specifically, as shown in FIG. 4*a,* at the beginning of the exhaust valve actuation stroke, tappet body 34 is positioned axially in tappet housing 32 so as to fluidically connect the first set of transfer passages 80 with the high pressure actuating fluid supply 38 via supply port 42. Meanwhile, second set of transfer passages 82 is fluidically connected with drain circuit 44 via one of the drain ports 46. In this position, high pressure fluid flows through the first set of transfer passages 80 and forces trigger plunger 70 away from check ball 62 while the high pressure actuating fluid flows into high pressure chamber 78 both forcing tappet piston 52 upwardly as shown in FIG. 4*a* and forcing check ball 62 against valve seat 64. Trigger extension 74 does not interfere with the seating of check ball 62 since trigger plunger 70 has been moved into a retracted position away from check ball 62. As a result, the effective length of the tappet device has been expanded by the distance tappet piston 52 has moved to the right from the collapsed position shown in FIG. 3. This effective lengthening of tappet device 31 causes a greater degree of movement of pushrod assembly 26 and pivoting of rocker arm 22 for a given rotation of the cam shaft (not shown) thereby causing the opening of exhaust valves 12 to be advanced to a crank angle earlier than the normal opening crank angle. During the opening portion of the exhaust valve actuation stroke of the tappet device, as shown in FIG. 4*b*, after a predetermined upward movement of tappet body 34, first set of transfer passages 80 move out of alignment with supply port 42 and into alignment with drain port 46 while the second set of transfer passages 82 move out of alignment with drain port 46 and into alignment and fluidic communication with supply port 42. As a result, the high pressure fluid and the bias force of spring 72 acting on trigger plunger 70 force trigger plunger 70 toward check ball 62 causing check ball 62 to move away from valve seat 64 thereby collapsing the hydraulic link formed in high pressure chamber 78. The high pressure fluid in chamber 78 and the first set of transfer passages 80 is spilled into drain circuit 44 causing depressurization of chamber 78 and movement of the tappet device into the collapsed state as shown in FIG. 3. As the tappet body 34 moves downwardly as shown in FIG. 2 during the closing portion of the valve actuation stroke, actuating fluid supply 34 is depressurized so as to ensure the tappet device remains in the collapsed state as the first and second set of transfer passages 80, 82 realign with the supply port 42 and drain ports 46, respectively. As a result, the normal predetermined timing of exhaust valve closing is maintained at a normal closing crank angle NCCA (FIG. 1). After exhaust valves 12 are moved into the closed position, actuating fluid supply 38 is again controlled to increase the pressure of the actuating fluid in supply circuit 40 to cause the tappet device to move into the expanded state before the next valve actuation stroke.

Figure 11:
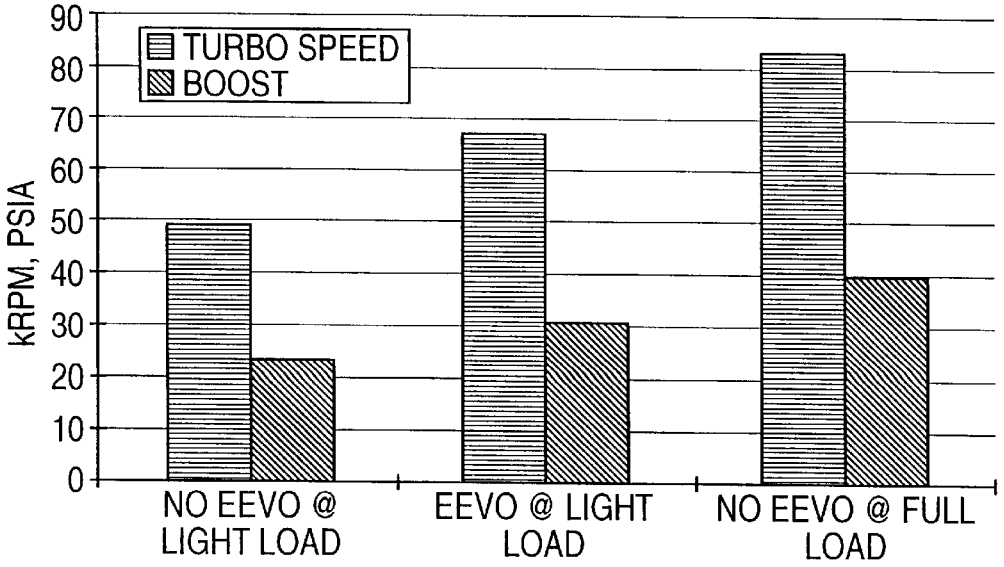
FIG. 11 is a graphical illustration representing a comparison of the turbocharger speed and boost pressure in a turbocharged diesel engine with and without actuation of the early exhaust valve opening control system of the present invention.

Referring to FIG. 1, the exhaust valve system of the present embodiment thus functions to open exhaust valves 12 at an advanced opening crank angle (AOCA) occurring much earlier in the expansion stroke of the piston than the normal opening crank angle (NOCA) which occurs during a normal timing mode. Specifically, the tappet device of the present invention may be deactivated under certain engine conditions, i.e. at medium and high load or speed conditions so that the tappet device remains in the collapsed state, and the exhaust valve system 10 in the normal timing mode, throughout operation of exhaust valves 12. An early or advanced exhaust valve opening is not as advantageous during these conditions since sufficient exhaust gas flow is delivered to the turbocharger turbine to provide the desired intake boost. However, during engine transient conditions when the engine is moving from an idle or light load condition toward a medium or high load condition, the present exhaust valve control device 16 permits the exhaust valves to be opened early, for example, prior to the transient event, to deliver additional exhaust energy to the turbocharger turbine thereby increasing the idle or light load turbocharger speed. Thus, as shown in FIG. 11, the early exhaust valve opening provided by the present invention decreases the response time necessary to achieve the level of boost required for high load operation since the turbocharger is able to provide greater boost at the light load condition. As a result, the engine more quickly responds to load increases by providing more output faster during the transient. Also, since the turbocharger is operating at a greater speed at idle and light loads, the engine will maintain a higher low speed engine torque desirable in certain applications. Importantly, the tappet device of the present invention advantageously advances the timing of the opening of the exhaust valve without affecting the timing of the closing of the exhaust valve at the NCCA thereby avoiding undesirable interference with the intake stroke thus ensuring maximum charge air intake. The interference could occur if the exhaust valve is maintained open too long into the intake stroke, e.g. exhaust valve closing advanced with the exhaust valve opening, thereby disadvantageously reducing the charge air intake flow.

Figure 5:
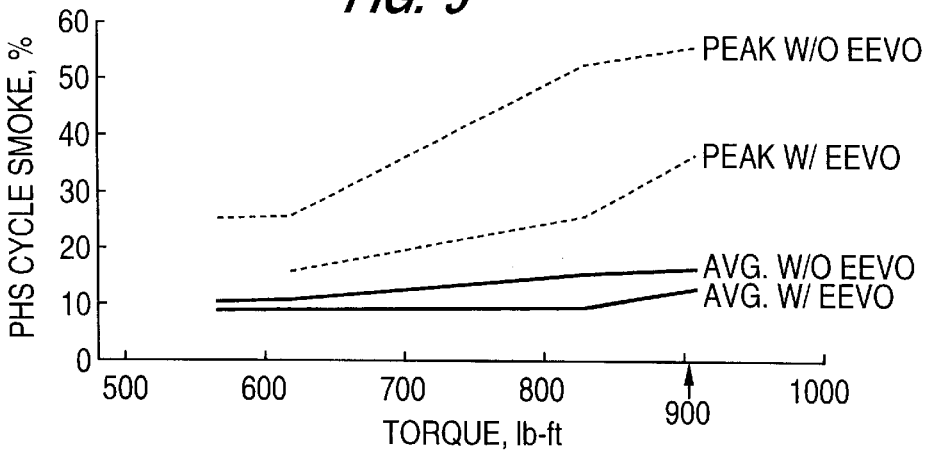
FIG. 5 is a graphical illustration representing a comparison of the degree of smoke in the exhaust gas of a turbocharged diesel engine with and without the early exhaust valve opening control of the present invention as illustrated in FIG. 1.
Figure 6:
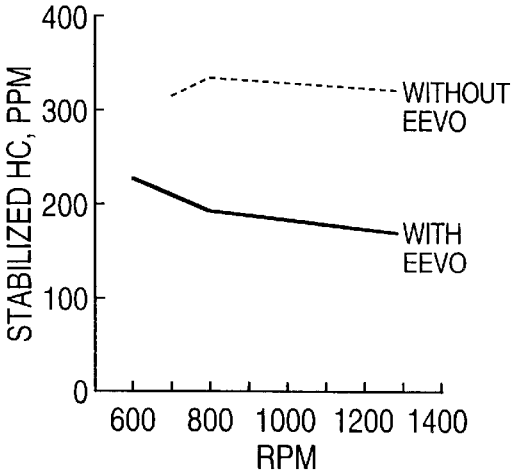
FIG. 6 is a graphical illustration representing a comparison of the amount of hydrocarbon emissions in the exhaust gas of a turbocharged diesel engine with and without the early exhaust valve opening control of the present invention.
Figure 7:
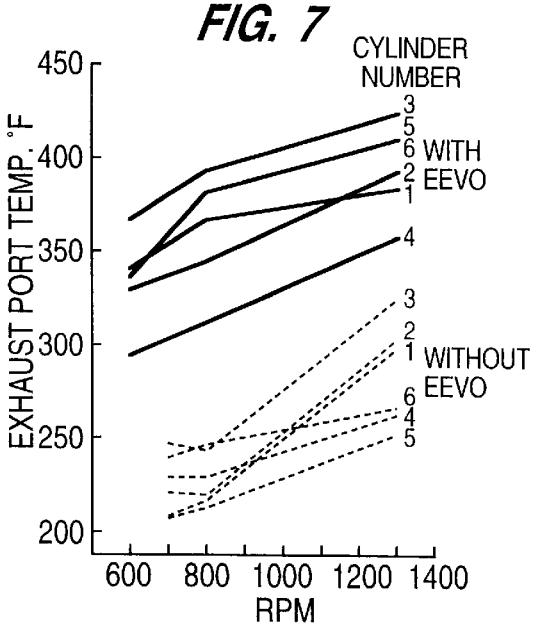
FIG. 7 is a graphical illustration representing a comparison of the exhaust port temperature in a turbocharged diesel engine with and without the early exhaust valve opening control of the present invention.

FIG. 7 clearly shows an increase in the exhaust port temperature during early exhaust valve opening with the device of the present embodiment thus illustrating the extra exhaust energy being provided to the turbocharger turbine. The exhaust valve control device 16 of the present invention also results in other advantages. Specifically, as shown in FIG. 5, the early exhaust valve opening significantly reduces the average and peak quantities of smoke in the exhaust flow during engine transient or acceleration periods. Moreover, as shown in FIG. 6, exhaust hydrocarbons were significantly reduced over a range of engine speeds at no load.

Figure 8:
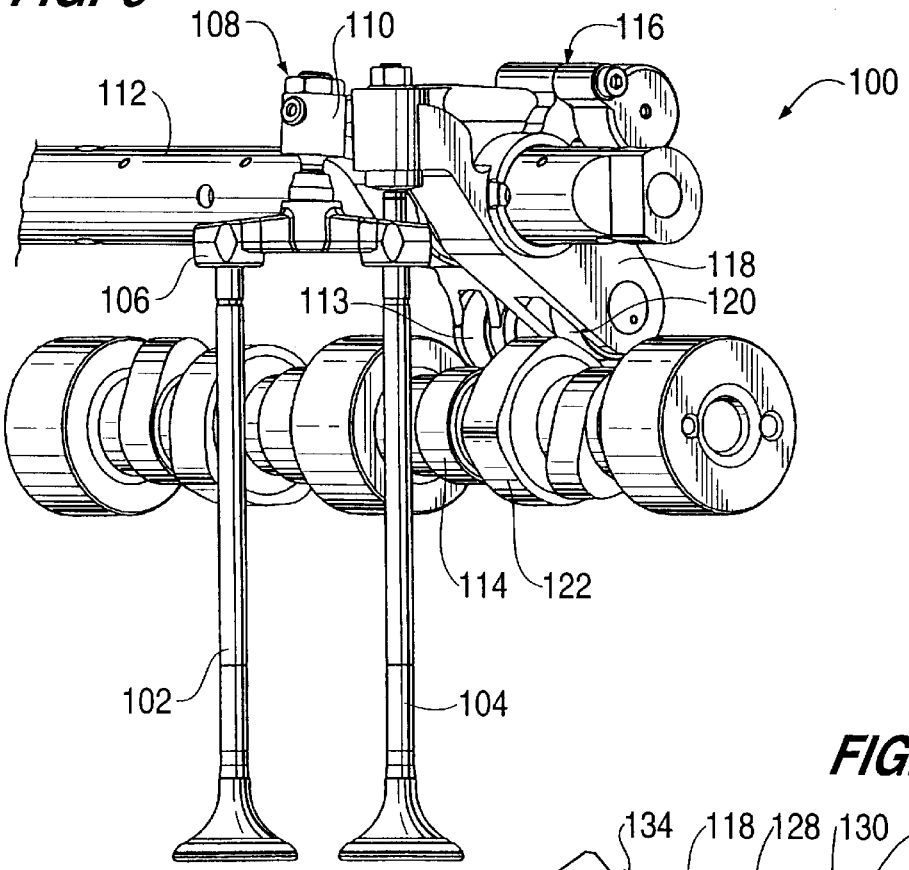
FIG. 8 is a perspective view of a second embodiment of the present exhaust valve system.
Figure 9:
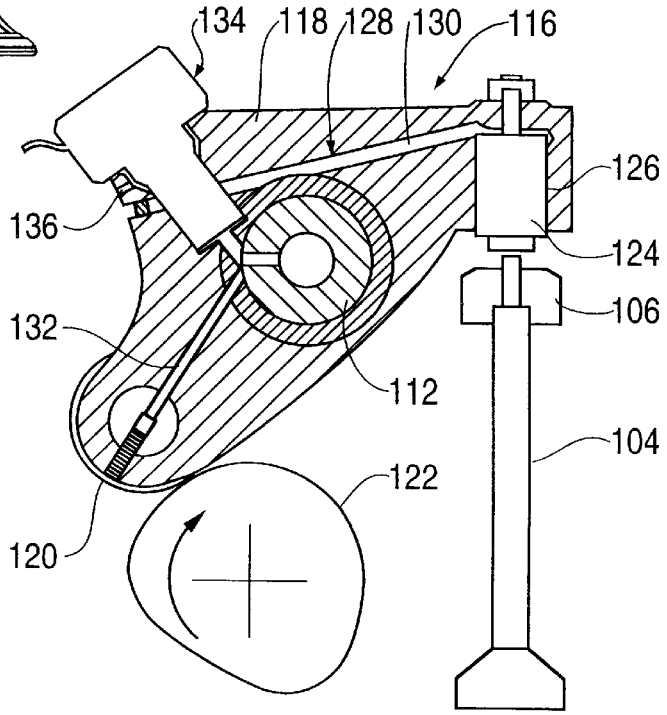
FIG. 9 is a diagrammatic cross sectional illustration of the advanced timing mode rocker lever of the exhaust valve control device of FIG. 8.
Figure 10:
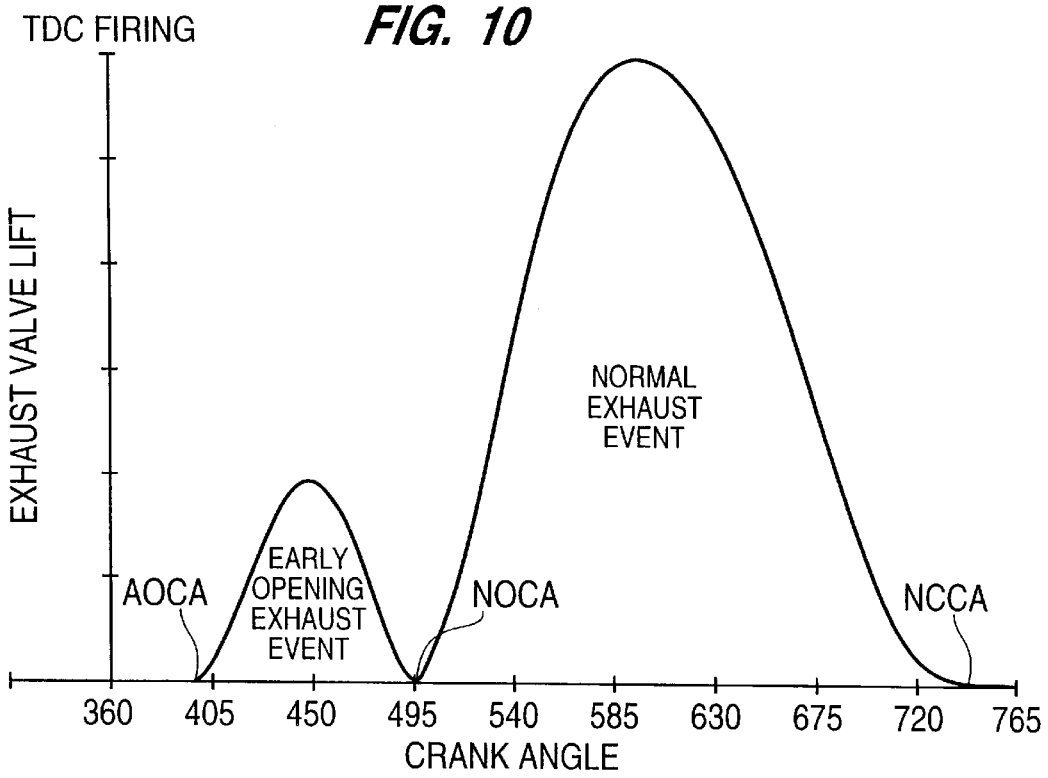
FIG. 10 is a graphical illustration representing the degree of exhaust valve lift or opening versus time measured by degrees of engine crankshaft rotation relating to the embodiment of FIGS. 8 and 9.

Now referring to FIGS. 8 and 9, there is shown a second embodiment of the present exhaust valve system, indicated generally at 100, for achieving an early exhaust valve opening. Exhaust valve system 100 includes a first exhaust valve 102 and a second exhaust valve 104 connected to a cross head assembly 106 operated by an exhaust valve actuating system 108 including a normal mode rocker lever 110 pivotally mounted on a rocker shaft 112. Normal mode rocker lever 110 includes, in a conventional manner, a cam roller 113 for abutment against a normal cam lobe 114 having a profile shaped to cause exhaust valves 102, 104 to lift during a normal exhaust valve event as shown in FIG. 10. Exhaust valve actuating system 108 also includes an exhaust valve control device 116 including an advanced timing mode rocker lever 118 pivotally mounted on rocker shaft 112. Advanced timing mode rocker lever 118 includes a cam roller 120 positioned to abut an advanced cam lobe 122 mounted on the cam shaft. Advanced cam lobe 122 includes a cam profile having a shape capable of causing advanced timing mode rocker lever 118 to pivot through an early opening exhaust valve stroke to open and close the second exhaust valve 104, prior to the normal exhaust valve event as shown in FIG. 10, to form an early or advanced opening exhaust event when operating in the advanced timing mode. Advanced timing mode rocker lever 118 imparts an actuating force to one end of second exhaust valve 104 during the early opening exhaust valve event. The proximal end of second exhaust valve 104 extends through cross head assembly 106 to contact one end of advanced timing mode rocker lever 118.

Referring to FIG. 9, advanced timing mode rocker lever 118 is identical to the rocker lever described in detail in U.S.

Pat. No. 5,626,116 entitled *Dedicated Rocker Lever and Cam Assembly for a Compression Braking System,* the entire contents of which are incorporated herein by reference. Although the braking rocker lever described in U.S. Pat. No. 5,626,116 is used in a braking system as disclosed, the same rocker lever can be used alternatively as an advanced timing mode rocker lever to achieve selective actuation of second exhaust valve 104 in substantially the same manner as described in U.S. Pat. No. 5,626,116. However, advanced cam lobe 122 must have a profile designed to achieve the early opening exhaust valve event shown in FIG. 10. Although advanced timing mode rocker lever 118 will not be described herein in detail, rocker lever 118 includes an actuator piston 124 positioned in actuator piston bore 126 formed in one end of rocker lever 118, a control fluid circuit 128 including a high pressure circuit 130 and a low pressure circuit 132, and a control fluid valve 134 for controlling the flow of control fluid between high pressure circuit 130, low pressure circuit 132 and a drain passage 136. Control fluid valve 134 is operated to move actuator piston 124 toward the proximal end of second exhaust valve 104 during the advanced timing mode thereby permitting cam 122 to initiate movement of the second exhaust valve 104. The earlier control fluid valve 134 is actuated to move actuator piston into an extended position during the rotation of advanced cam lobe 122, the more advanced the timing of the early exhaust valve opening becomes. It should be noted that second exhaust valve 104 is operated by advanced timing mode rocker lever 118 independently of valve cross head assembly 106 and first exhaust valve 102. In order to maintain a balanced load on cross head assembly 106 and first and second exhaust valves 102, 104, preferably, the early opening exhaust event is completed by closing second exhaust valve 104 prior to opening both first and second exhaust valves 102, 104 during the normal exhaust event. Thus, during the normal timing mode of operation, when the engine is operating at above idle and light load conditions, normal mode rocker lever 110 intermittently actuates first and second exhaust valves 102 and 104 to create the normal exhaust valve event shown in FIG. 10 without any early opening event. However, under idle or light load conditions, an engine electronic control module (ECM) may determine the need for increased boost, for example, due to a future transient condition. In this situation, the ECM would control the operation of control fluid valve 134 in timed relation to the rotation of cam lobe 122, and the rotation of normal cam lobe 114 which defines the normal exhaust event, so as to begin actuating second exhaust valve 104 to create the early opening exhaust event thereby operating in the advanced timing mode. Specifically, second exhaust valve 104 will open during the advanced timing mode at an advanced opening crank angle AOCA substantially prior to the normal opening crank angle NOCA, i.e. 30–80 crank angle degrees prior to the normal opening crank angle. Second exhaust valve 104 will then be closed prior to the reopening of both first and second exhaust valves 102, 104 at the beginning of the normal exhaust event. Like the previous embodiment, exhaust valve control device 116 of the present embodiment also maintains the timing of the normal closing of the exhaust valves at the normal closing crank angle NCCA.

As shown in FIG. 11, the turbocharger speed must go from 49,000 rpm to 83,000 rpm when operating in the normal timing mode without the early exhaust valve opening system of the present invention. The addition of the early exhaust valve opening system of the present invention and use of the system in the advanced timing mode increases the turbocharger speed at light load to 67,000 rpm, a 31% increase in turbocharger speed. As a result, the time required for the turbocharger to increase to a full load speed is significantly decreased thereby dramatically improving engine transient response due to the additional turbocharger intake boost occurring earlier in the transient. Thus, both embodiments of the present invention significantly reduce the time required for a turbocharged diesel engine to effectively increase from low load operation to higher load operation.

Industrial Applicability

The exhaust valve system, including the exhaust valve control devices, of the present invention are particularly advantageous for use in diesel engines having turbochargers and operated under varying load conditions requiring optimum engine transient response.

We claim:

1. An exhaust valve system for an internal combustion engine having a crankshaft mounted for rotation, at least one engine piston operatively connected to the crankshaft for reciprocal movement within a cylinder through cyclical successive compression and expansion strokes, an exhaust system and a turbocharger positioned in the exhaust system, comprising:

at least one exhaust valve reciprocally mounted in the engine for movement between open and closed positions;

an exhaust valve actuating means for moving said at least one exhaust valve between said open position and said closed position, said exhaust valve actuating means including an exhaust valve opening control means for varying the timing of the opening of said at least one exhaust valve during engine operation, said exhaust valve opening control means operable in a normal timing mode for permitting normal opening of said at least one exhaust valve at a normal opening crank angle prior to an end of the expansion stroke and subsequently permitting normal closing of said at least one exhaust valve at a normal closing crank angle, and in an advanced timing mode during at least one of idle engine conditions and low load engine conditions for advancing the timing of the opening of said at least one exhaust valve to an advanced opening crank angle substantially prior to said normal opening crank angle while maintaining the timing of normal closing of said at least one exhaust valve at said normal closing crank angle so as to increase the speed of the turbocharger during operation in said advanced timing mode.

2. The system of claim 1, wherein said exhaust valve opening control means operates in said advanced timing mode to close said at least one exhaust valve subsequent to the advanced opening of said at least one exhaust valve to permit subsequent reopening of said at least one exhaust valve prior to the normal closing of said at least one exhaust valve.

3. The system of claim 2, wherein said exhaust valve actuating means includes a normal mode rocker lever pivotally mounted adjacent said at least one exhaust valve for opening said at least one exhaust valve when said exhaust valve opening control means is operating in said normal timing mode and a first cam means for pivoting said normal mode rocker lever, said exhaust valve opening control means including an advanced timing mode rocker lever pivotally mounted adjacent said at least one exhaust valve for opening said at least one exhaust valve when said exhaust valve opening control means is operating in said advanced timing mode and a second cam means for pivoting said advanced timing mode rocker lever.

4. The system of claim 3, wherein said exhaust valve opening control means further includes a control fluid circuit formed in said advanced timing mode rocker lever and a control fluid valve means for controlling the flow of control fluid through said control fluid circuit.

5. The system of claim 4, wherein said control fluid circuit includes a low pressure circuit for delivering low pressure fluid to said control fluid valve means and a high pressure circuit for receiving low pressure fluid from said low pressure circuit, said control fluid valve means operable to control the flow of control fluid between said low pressure circuit and said high pressure circuit.

6. The system of claim 5, wherein said control fluid valve means is mounted on said advanced timing mode rocker lever.

7. The system of claim 6, wherein said second cam means pivots said advanced timing mode rocker lever by applying an advanced timing mode actuating force to a first end of said advanced timing mode rocker lever positioned adjacent said second cam means, further including an actuator piston bore formed in a second end of said advanced timing mode rocker lever, and an actuator piston slidably mounted in said actuator piston bore.

8. The system of claim 1, wherein said at least one exhaust valve includes a first exhaust valve for opening solely by said normal mode rocker lever during said normal timing mode and a second exhaust valve for opening by both said normal mode rocker lever and said advanced mode rocker lever during said advanced timing mode.

9. The system of claim 1, wherein said exhaust valve opening control means includes a tappet means operable in an expanded state to cause said advanced timing mode and a collapsed state for permitting operation in said normal timing mode.

10. The system of claim 9, wherein said tappet means is movable through an exhaust valve actuation stroke including an opening stroke portion moving said at least one exhaust valve from said closed to said open position and a closing stroke portion moving said at least one exhaust valve from said open to said closed position, said tappet means transitioning from said expanded state to said collapsed state during said opening stroke portion.

11. The system of claim 9, wherein said exhaust valve actuating means includes a rocker arm and a pushrod assembly, said tappet means being positioned along said pushrod assembly.

12. The system of claim 9, wherein said exhaust valve opening control means includes an actuating fluid supply means for selectively supplying pressurized actuating fluid to initiate said advanced timing mode, said tappet means including an actuating fluid circuit for receiving said pressurized actuating fluid, further including a drain circuit for draining fluid from said actuating fluid circuit.

13. The system of claim 12, wherein said tappet means includes a tappet housing and a tappet body mounted for reciprocal movement in said tappet body, said drain circuit including at least one drain port formed in said tappet housing, said tappet body movable through an exhaust valve actuation stroke during said advanced timing mode to sequentially connect said actuating fluid circuit to said actuating fluid supply means to place said tappet means in said expanded state and subsequently fluidically connect said actuating fluid circuit to said drain port for placing said tappet means in said collapsed state during movement through said actuation stroke.

14. The system of claim 1, wherein said exhaust valve opening control means advances the timing of the opening of said at least one exhaust valve to an advanced opening crank angle at least 90 crank angle degrees prior to an end of the expansion stroke of the piston.

15. An exhaust valve system for an internal combustion engine having a crankshaft mounted for rotation, at least one engine piston operatively connected to the crankshaft for reciprocal movement within a cylinder through cyclical successive compression and expansion strokes, an exhaust system and a turbocharger positioned in the exhaust system, comprising:

at least one exhaust valve reciprocally mounted in the engine for movement between open and closed positions;

an exhaust valve actuating means for moving said at least one exhaust valve between said open position and said closed position, said exhaust valve actuating means including an exhaust valve opening control means for varying the timing of opening of said at least one exhaust valve during engine operation, said exhaust valve opening control means operable in a normal timing mode for permitting normal opening of said at least one exhaust valve at a normal opening crank angle and subsequently permitting normal closing of said at least one exhaust valve at a normal closing crank angle, and in an advanced timing mode during at least one of idle engine conditions and low load engine conditions for advancing the timing of the opening of said at least one exhaust valve to an advanced opening crank angle at least 90 crank angle degrees prior to an end of the expansion stroke so as to increase the speed of the turbocharger during operation in said advanced timing mode.

16. The system of claim 15, wherein the timing of the opening of said at least one exhaust valve to said advanced opening crank angle is advanced when in said advanced timing mode while maintaining the timing of normal closing of said at least one exhaust valve.

17. The system of claim 15, wherein said exhaust valve opening control means operates in said advanced timing mode to close said at least one exhaust valve subsequent to the advanced opening of said at least one exhaust valve to permit subsequent reopening of said at least one exhaust valve prior to the normal closing of said at least one exhaust valve.

18. The system of claim 17, wherein said exhaust valve actuating means includes a normal mode rocker lever pivotally mounted adjacent said at least one exhaust valve for opening said at least one exhaust valve when said exhaust valve opening control means is operating in said normal timing mode and a first cam means for pivoting said normal mode rocker lever, said exhaust valve opening control means including an advanced timing mode rocker lever pivotally mounted adjacent said at least one exhaust valve for opening said at least one exhaust valve when said exhaust valve opening control means is operating in said advanced timing mode and a second cam means for pivoting said advanced timing mode rocker lever.

19. The system of claim 18, wherein said exhaust valve opening control means further includes a control fluid circuit formed in said advanced timing mode rocker lever and a control fluid valve means for controlling the flow of control fluid through said control fluid circuit, said control fluid valve means being mounted on said advanced timing mode rocker lever.

20. The system of claim 19, wherein said second cam means pivots said advanced timing mode rocker lever by applying an advanced timing mode actuating force to a first end of said advanced timing mode rocker lever positioned adjacent said second cam means, further including an actuator piston bore formed in a second end of said advanced timing mode rocker lever, and an actuator piston slidably mounted in said actuator piston bore.

21. The system of claim 15, wherein said at least one exhaust valve includes a first exhaust valve for opening solely by said normal mode rocker lever during said normal timing mode and a second exhaust valve for opening by both said normal mode rocker lever and said advanced mode rocker lever during said advanced timing mode.

22. The system of claim 15, wherein said exhaust valve opening control means includes a tappet means operable in an expanded state to cause said advanced timing mode and a collapsed state.

23. The system of claim 22, wherein said tappet means is movable through an exhaust valve actuation stroke including an opening stroke portion moving said at least one exhaust valve from said closed to said open position and a closing stroke portion moving said at least one exhaust valve from said open to said closed position, said tappet means transitioning from said expanded state to said collapsed state during said opening stroke portion.

24. The system of claim 23, wherein said exhaust valve actuating means includes a rocker arm and a pushrod assembly, said tappet means being positioned along said pushrod assembly.

25. The system of claim 23, wherein said exhaust valve opening control means includes an actuating fluid supply means for selectively supplying pressurized actuating fluid to initiate said advanced timing mode, said tappet means including an actuating fluid circuit for receiving said pressurized actuating fluid, further including a drain circuit for draining fluid from said actuating fluid circuit.

26. The system of claim 25, wherein said tappet means includes a tappet housing and a tappet body mounted for reciprocal movement in said tappet body, said drain circuit including at least one drain port formed in said tappet housing, said tappet body movable through an exhaust valve actuation stroke during said advanced timing mode to sequentially connect said actuating fluid circuit to said actuating fluid supply means to place said tappet means in said expanded state and subsequently fluidically connect said actuating fluid circuit to said drain port for placing said tappet means in said collapsed state during movement through said actuation stroke.

27. A method for controlling the timing of opening of an exhaust valve in an internal combustion engine having a crankshaft mounted for rotation, at least one engine piston operatively connected to the crankshaft for reciprocal movement within a cylinder through cyclical successive compression and expansion strokes, an exhaust system and a turbocharger positioned in the exhaust system, comprising:

providing at least one exhaust valve mounted in the engine for movement between open and closed positions;

operating the engine in a normal timing mode causing normal opening of said at least one exhaust valve at a normal opening crank angle prior to an end of the expansion stroke and subsequently permitting normal closing of said at least one exhaust valve at a normal closing crank angle;

changing the operation of the engine from said normal timing mode to an advanced timing mode during at least one of idle engine conditions and low load engine conditions for advancing the timing of the opening of said at least one exhaust valve to an advanced opening crank angle earlier than said normal opening crank angle while maintaining the timing of normal closing of said at least one exhaust valve at said normal closing crank angle so as to increase the speed of the turbocharger during operation in said advanced timing mode.

* * * * *